US008291522B2

(12) United States Patent
Kueng

(10) Patent No.: US 8,291,522 B2
(45) Date of Patent: Oct. 23, 2012

(54) HYBRID WATERLESS URINAL

(75) Inventor: Georg Kueng, Kissimmee, FL (US)

(73) Assignee: XELA Innovations, LLC, Glendale, WI (US)

( * ) Notice: Subject to any disclaimer, the term of this patent is extended or adjusted under 35 U.S.C. 154(b) by 23 days.

(21) Appl. No.: 12/886,164

(22) Filed: Sep. 20, 2010

(65) Prior Publication Data

US 2012/0066822 A1 Mar. 22, 2012

(51) Int. Cl.
*A47K 11/00* (2006.01)

(52) U.S. Cl. ..... 4/144.1

(58) Field of Classification Search ..... 4/144.1–144.4
See application file for complete search history.

(56) References Cited

U.S. PATENT DOCUMENTS

| | | | | |
|---|---|---|---|---|
| 4,309,781 | A | 1/1982 | Lissau | |
| 5,711,037 | A * | 1/1998 | Reichardt et al. | 4/301 |
| 7,111,332 | B1 | 9/2006 | Hsia | |
| 2005/0039248 | A1 | 2/2005 | DeMarco | |
| 2008/0295233 | A1 * | 12/2008 | Fima | 4/144.1 |
| 2010/0205725 | A1 * | 8/2010 | McAlpine | 4/144.1 |

* cited by examiner

*Primary Examiner* — Lori Baker
(74) *Attorney, Agent, or Firm* — Daniel Law Offices, P.A.; Jason T Daniel, Esq.

(57) ABSTRACT

A hybrid waterless urinal includes a main body having an integrally formed elongated receptacle for receiving an effluent liquid, a drain unit having a reservoir, a primary P-trap and an integrated one way valve for storing and removing the effluent liquid from the urinal, a washout channel for providing fresh water under pressure to the drain unit and a secondary P-trap positioned inside the washout channel.

19 Claims, 7 Drawing Sheets

HYBRID WATERLESS URINAL

BACKGROUND

1. Field of the Invention

The present invention relates generally to a urine receptacle, and more particularly to a hybrid waterless urinal having a water flush capability.

2. Description of the Related Art

As fresh water shortages become commonplace in municipalities across the globe, new emphasis has been placed on water conservation. One major source of water consumption comes from restroom facilities employing conventional water based urinals that require fresh water after each use. To combat this situation, waterless urinals have been commercially available for a number of years. However, the popularity of these devices has suffered due to the belief that these devices will emanate unpleasant odors, and that urine sediment can clog building drain lines if not flushed with fresh water.

Accordingly, the need exists for a hybrid type waterless urinal which incorporates the economic and environmental benefits of a waterless urinal with the ability to provide a fresh water flush capability.

SUMMARY OF THE INVENTION

The present invention is directed to a hybrid waterless urinal having a water flush capability. One embodiment of the present invention can include a main body having an integrally formed elongated receptacle for receiving an effluent liquid, a drain unit having an integrated one way valve for storing and removing the effluent liquid from the urinal, and a washout channel for providing fresh water under pressure to the drain unit.

Another embodiment of the present invention can include a urinal having a secondary P-trap in the washout channel.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used throughout this specification, a "hybrid" urinal can include a waterless urinal having a water flush capability which can be controlled by a user. As such, a hybrid waterless urinal can operate as a waterless urinal, a water use urinal and as a combination of both, as will be described in detail below.

Figure 1:
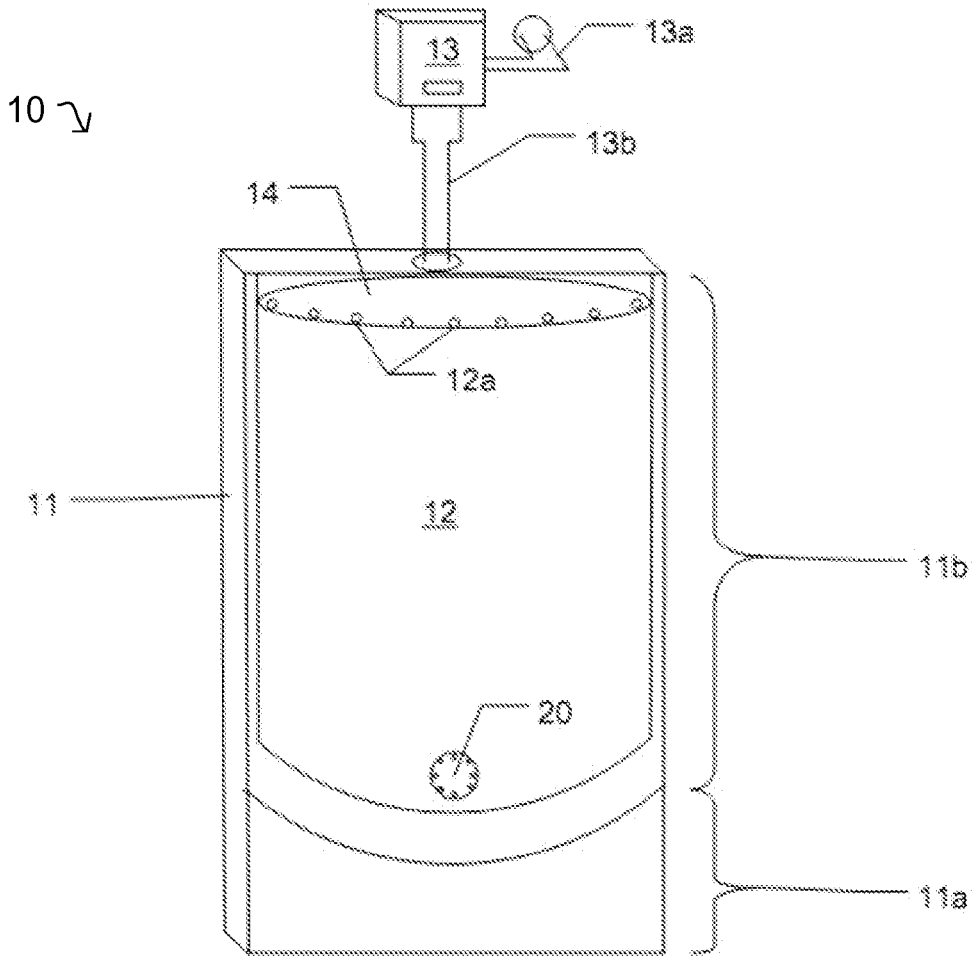
FIG. 1 is a frontal elevation of a hybrid waterless urinal that is useful for understanding the inventive concepts disclosed herein.
Figure 2:
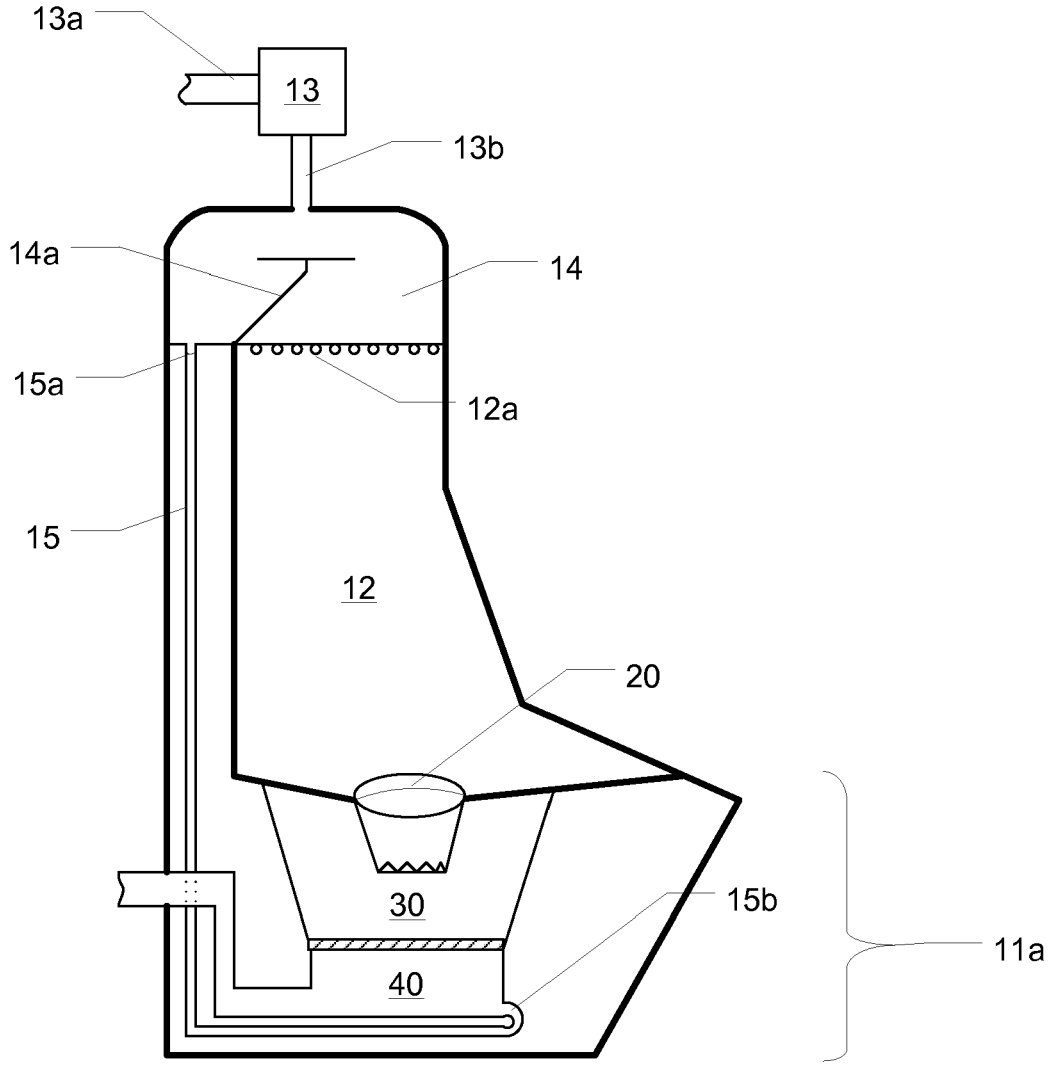
FIG. 2 is a side view of a hybrid waterless urinal according to one embodiment of the present invention.

FIGS. 1 and 2 illustrate one embodiment of a hybrid urinal that is useful for understanding the inventive concepts disclosed herein. As shown, urinal 10 can include a lower body 11*a*, and an upper body 11*b* having an integrally formed elongated bowl-like receptacle 12 for receiving an effluent liquid. Urinal 10 may be formed of any type of material that is resistant to elements such as liquids and gases, the material including but not limited to ceramic, plastic, glass, metal and/or composite materials. The outer surface of the body 11 may be of any shape, while the inner surface/receptacle 12 should have a curvilinear shape as above described and may be independent of the shape of the outer surface.

One embodiment of the urinal 10 can further include an automatic flush valve 13, a flow diverter 14, a washout channel 15, a collection unit 20, a reservoir 30 and a primary p-trap 40.

The automatic flush valve 13 can act to independently initiate a flush operation of the urinal and can include a water inlet 13*a* connected to the water supply of a building, and an outlet chamber 13*b* for depositing the water into the upper body 11*b* of the urinal. In one embodiment, the flush valve 13 can include adjustable settings to allow a user to specify the amount of water used for each flush in addition to regulating how often the urinal will flush. Automatic flush valves of this type are extremely well known in the art, and include U.S. Pat. No. 4,309,781, for example, the contents of which are incorporated herein by reference.

As shown in FIG. 2, the flow diverter 14 can act to distribute water from the outlet chamber 13*b* into both the washout channel 15 and the receptacle 12 via a plurality of inlet holes 12*a*. In one preferred embodiment, the flow diverter 14 can include a flange 14*a* positioned within the flow diverter and located at the top of the body 11*b*, just beneath the outlet chamber 13*b* in such a manner as to direct ⅓ of the water volume into the receptacle 12, and the remaining ⅔ of the water volume into the washout channel 15; however, other locations and flow ratios are also contemplated. As used herein, a flange 14*a* can include any number of known internal dividers capable of manipulating the path of a liquid.

Figure 2A:
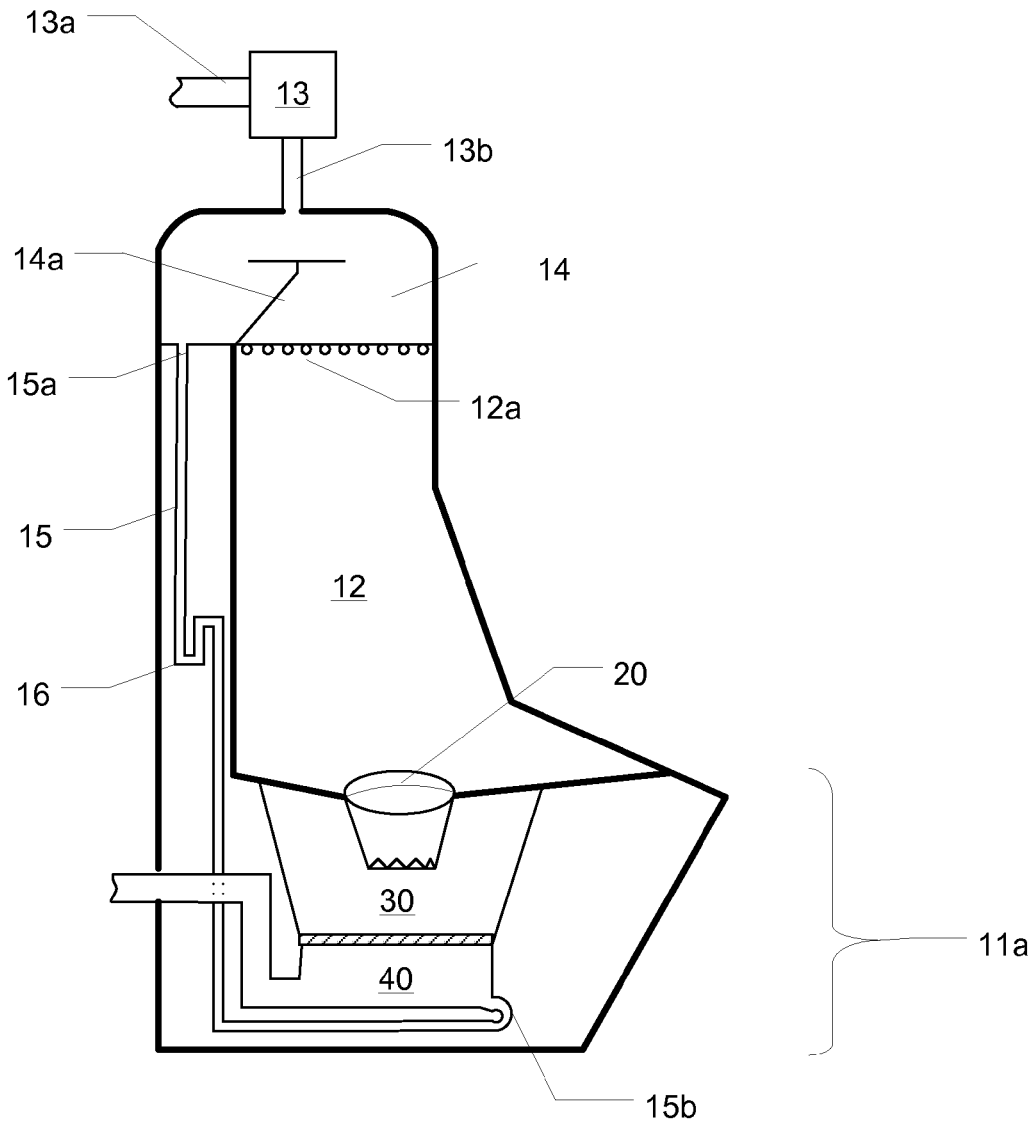
FIG. 2*a* is a side view of a hybrid waterless urinal according to one embodiment of the present invention.

The washout channel 15 can act to flush all fluids from the reservoir 30 and the primary P-trap 40 which will be described below in detail. As such, in one embodiment, washout channel 15 can be positioned along the back side of the urinal body 11 such that the top end 15*a* is connected to the flow diverter 14, and the bottom end 15*b* is connected to the urinals' primary P-trap 40. In another embodiment illustrated by FIG. 2*a*, the washout channel 15 can further include a secondary P-trap 16 for providing protection against unpleasant odors emanating from the reservoir 30 and the primary P-trap 40. P-traps being well known in the art, no further description will be provided. As described herein, washout channel 15 can be constructed from an elongated tubular member such as a hose or conduit, or may be formed within the inside walls of the urinal body 11 so as to create a water jacket.

Figure 3:
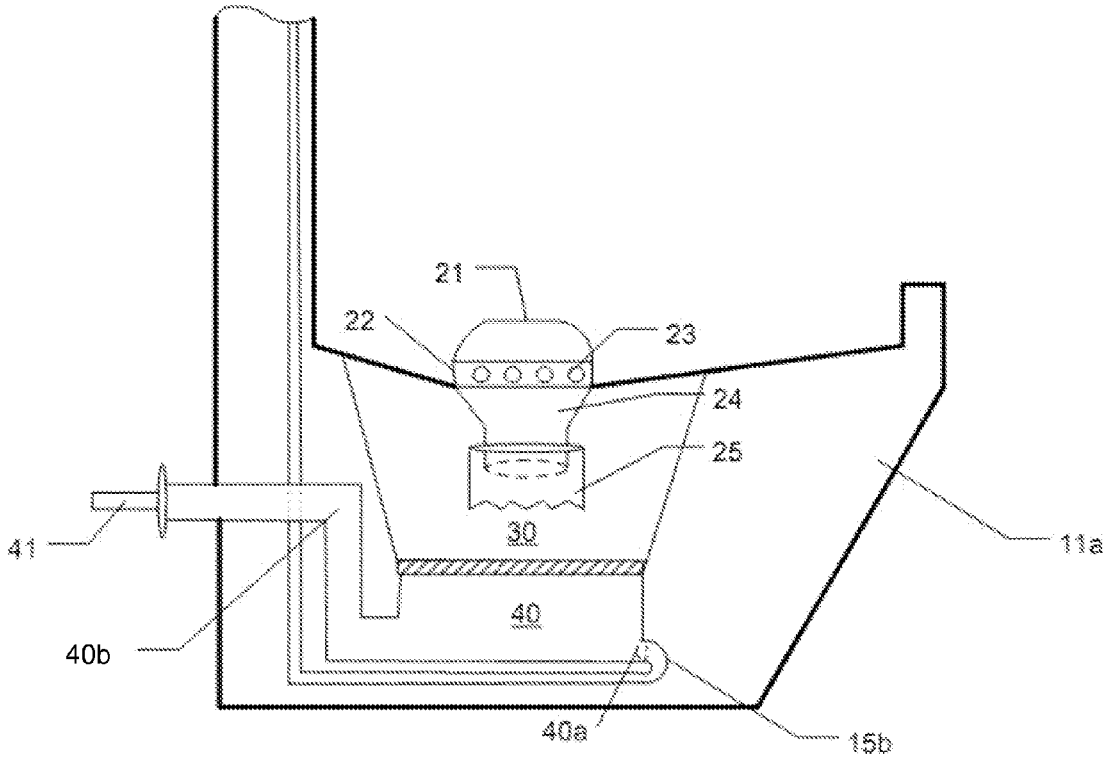
FIG. 3 is a detail view of a lower side portion of a hybrid waterless urinal according to one embodiment of the present invention.

The collection unit 20 can act to transfer all liquid from the receptacle 12 into the reservoir 30. As such, the collection unit 20 can preferably be constructed from injection molded plastic and be positioned along the lowermost portion of the receptacle 12. As shown in FIG. 3, one embodiment of a collection unit 20 can include a cap portion 21, a collection plate 22, one or more openings 23 which act as a urine inlet, a channel section 24 for transferring the urine into the reservoir 30, and a one way valve 25 positioned at the end of the channel section 24.

In one preferred embodiment, one way valve 25 can include an elastomeric check valve constructed from a rubberized membrane having a fixed opening at one end and a closeable opening at the other end, however other materials and shapes are also contemplated. As such, the one way valve 25 can act to allow any liquid received from the channel section 24 to flow downward into the reservoir 30 without allowing a backflow. Moreover, as the one way valve 25 is opened only when a liquid is flowing downward, the one way valve also acts to prevent any unpleasant odors from escaping the reservoir.

The reservoir 30 can act as a holding area for fluid. In one embodiment, a first end of the reservoir 30 can be connected to the primary P-trap 40, and the other end can be connected to the bottom side of the receptacle 12 so as to encompass at least a portion of the channel section 24 and the one way valve 25. In this regard, whenever an effluent liquid (such as urine) is deposited into the receptacle 12, the fluid will pass through the collection unit and ultimately make its way to the reservoir 30.

Figure 3A:
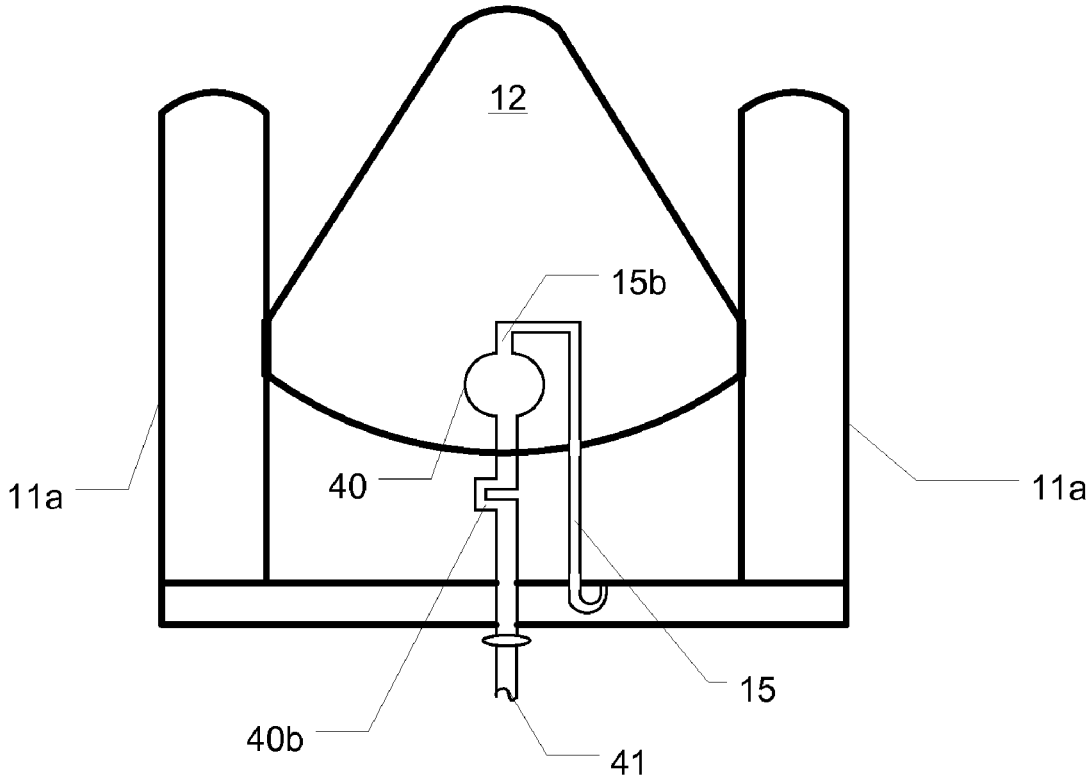
FIG. 3*a* is a plan view of a bottom portion of a hybrid waterless urinal according to one embodiment of the present invention.

The primary P-trap 40 can be connected to the bottom portion of the reservoir 30 such that any effluent liquid present in the reservoir will be gravity fed into the P-trap. Additionally, the primary P-trap 40 can further include an opening 40*a* for receiving the second end of the washout channel 15*b* (See FIG. 3*a*). To this end, whenever fresh water flows down through the washout channel 15, a pressure is created which is sufficient to push (i.e. flush) all effluent liquid from the reservoir 30 and the bottom portion of the P-trap 40 through the curve (40*b*) and into the building drain 41.

Figure 4:
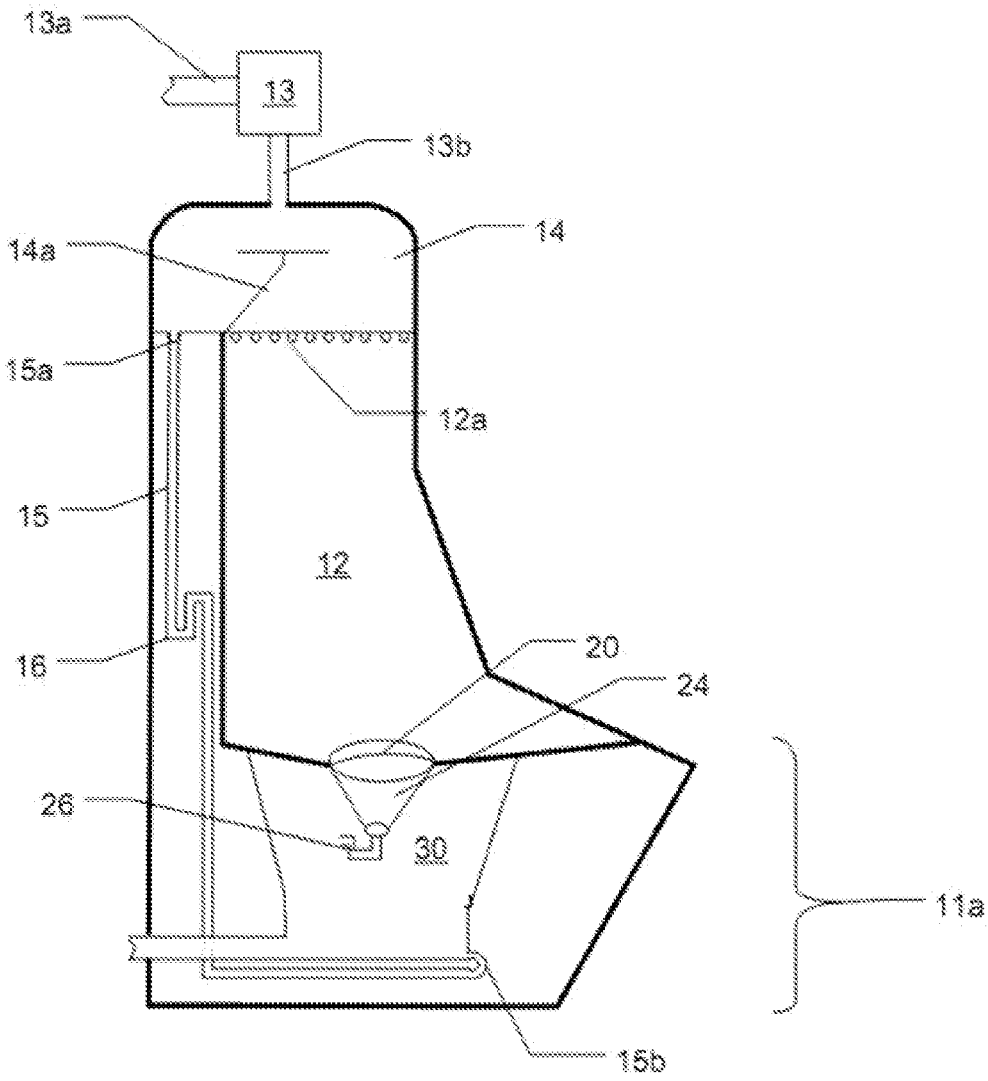
FIG. 4 is a side view of a hybrid waterless urinal in a waterless mode according to an alternate embodiment of the present invention.

Although described above as including both a one way valve and a primary P-trap, other embodiments are also contemplated. For example, FIG. 4 illustrates one alternate embodiment of a urinal 10 in which the channel section 24 of the collection unit includes an integrated P-trap 26 positioned at the lowermost end thereof. As shown, by integrating the P-trap 26 into the collection unit, the primary P-trap 40 described above can be eliminated. As such, the lower end of the washout channel 15*b* can be connected directly to the reservoir 30 (preferably at a bottom end thereof) and can act to evacuate the contents of the reservoir as described above.

As described herein, one or more elements of the hybrid urinal 10 can be secured together utilizing any number of known attachment means such as, for example, screws, glue, compression fittings, magnetic elements or other weather-resistant materials. Moreover, although the above embodiments have been described as including separate individual elements, the inventive concepts disclosed herein are not so limiting. To this end, one of skill in the art will recognize that one or more individual elements such as the collection unit 20 (including all sub elements), the reservoir 30 and/or the primary P-trap 40, for example, may be formed together as one continuous element, either through manufacturing processes, such as welding, casting, or molding, or through the use of a singular piece of material milled or machined with the aforementioned components forming identifiable sections thereof.

Figure 5:
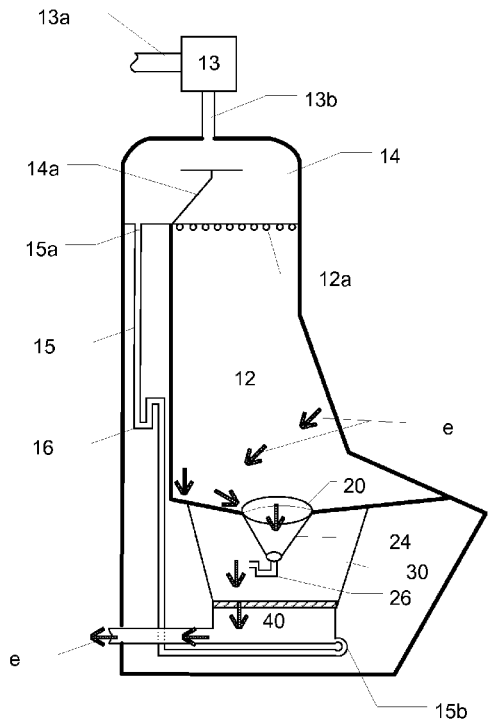
FIG. 5 is a side view of a hybrid waterless urinal in a water use mode according to one embodiment of the present invention.

In operation, the hybrid waterless urinal 10 described above can operate as both a waterless apparatus or as a water use apparatus having an extremely ecologically friendly low water consumption mode, depending on the needs of the user.

waterless mode: As shown in FIG. 5, the hybrid urinal 10 can operate as a waterless apparatus in which effluent liquids can be safely and sanitarily removed without the need for a fresh water flush after each use. To this end, urine e is deposited into the receptacle 12, it will make its way through the collection unit 20 and be deposited into reservoir 30 and the P-trap 40. Once through the collection unit, the one way valve 25 will close, thus preventing any unpleasant odors from escaping. As more urine is introduced, the additional weight of the new urine will cause the older urine to flow through the P-trap and be removed by the building drain.

In this regard, the one way valve 25 acts to perform the functionality of a traditional oil cartridge that is present in conventional waterless urinals. However, due to the fact that the one way valve 25 is not consumable, maintenance costs will be greatly reduced.

Figure 6:
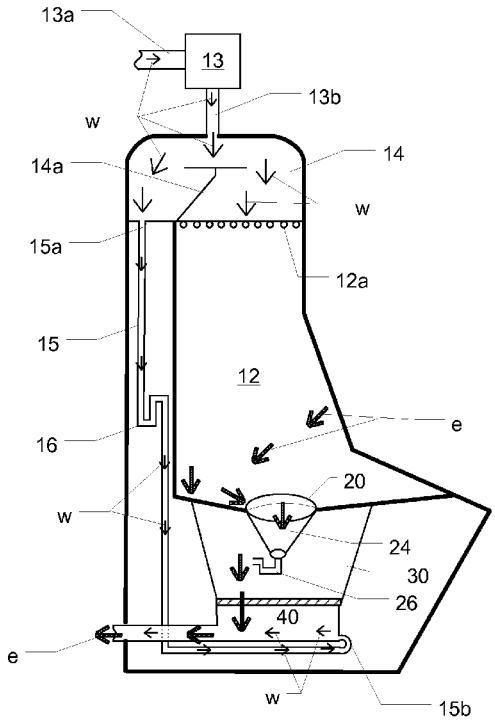
FIG. 6 is a side view of a hybrid waterless urinal in a waterless mode according to one embodiment of the present invention.

Water use mode: As shown in FIG. 6, the Hybrid urinal 10 can operate as a water use apparatus in which effluent liquids can be safely and sanitarily removed with the aid of fresh water after each use(or a set number) of uses. To this end, when urine e is deposited into the receptacle 12, it will make its way through the collection unit 20 and into the P-trap 40 as described above. Upon sensing that the user has left the area, the automatic flush valve 13 can then initiate a flush procedure by depositing water w into the flow diverter 14. In one embodiment, the size of the inlet holes 12*a* , can create a pool of water which can eventually back up into the diverter 14, thus providing the ⅓ to ⅔ water volume distribution described above.

In either case, a portion of the incoming water w will flow through the outlet holes 12*a* into the receptacle 12, until mixing with the urine e and coming to rest in the reservoir 30 and P-trap 40. The remaining portion of water w will travel down the washout channel 15, through the secondary P-trap 16 and into the bottom of the primary P-trap 40. Owing to the fact that water w inside the washout channel 15 is traveling from a higher position than the urine in the reservoir, the water entering the primary P-trap 40 will provide a pressure sufficient to flush the urine e through the P-trap 40 and into the building drain 41.

Hybrid use mode: Hybrid waterless urinal 10 can also operate in a hybrid mode in which the features of both the waterless and water use modes are utilized. To this end, in one embodiment of the present invention, the hybrid waterless urinal 10 can operate as a waterless urinal until the occurrence of a triggering event activates the flush operation. As used herein, several non limiting examples of a triggering event can include: an elapsed period of time (such as days or weeks, for example), a particular number of uses between flushes (as determined by the automatic sensor), and/or the fullness of the reservoir, among many others.

Accordingly, owing to the fact that the hybrid urinal 10 can safely and sanitarily operate for long periods of time without the need for a fresh water flush, it becomes possible to fully utilize the environmental benefits of a waterless urinal while providing a means for performing a periodic flush operation to clean the apparatus and to prevent sediment buildup. Additionally, by including the flush feature, a user or perspective purchaser who may have doubts as to the effectiveness of a waterless urinal can operate a single device in a plurality of customizable modes that best meets the particular needs of that person.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A hybrid waterless urinal comprising:

a body having an integrally formed elongated receptacle configured to receive an effluent liquid, said receptacle including a plurality of inlets positioned along a top periphery and an opening positioned along the bottom end thereof;

a collection unit positioned within said opening, said collection unit being configured to receive the effluent liquid from the receptacle;

a drain unit having a top portion connected to the collection unit, said drain unit being configured to store and remove the effluent liquid from the urinal;

a flush unit configured to provide water to the body;

a flow diverter having a top portion connected to the flush unit; and a washout channel having a top portion connected to the flow diverter and a bottom portion connected to the drain unit, said washout channel being configured to flush the effluent liquid from the drain unit, wherein said flow diverter is configured to adjustably distribute water to the washout channel and the receptacle.

2. The hybrid urinal of claim 1, wherein said washout channel includes a P-trap.

3. The hybrid urinal of claim 1, wherein said urinal is configured to function as a waterless urinal.

4. The hybrid urinal of claim 1, wherein said urinal is configured to function as a water-use urinal.

5. The hybrid urinal of claim 1, wherein said collection unit includes a one way valve, said one way valve being configured to allow fluids to pass into the drain unit while preventing odors from escaping therefrom.

6. The hybrid urinal of claim 5, wherein said one way valve includes a rubber membrane having an opening at one end and a closeable opening at another end.

7. The hybrid urinal of claim 5, wherein said one way valve consists of a rubber membrane.

8. The hybrid urinal of claim 1, wherein said drain unit includes a reservoir for storing a portion of the effluent liquid and a primary P-trap configured to be connected to a building drain.

9. The hybrid urinal of claim 8, wherein the reservoir is interposed between a bottom portion of the collection unit and a top portion of the primary P-trap.

10. The hybrid urinal of claim 8, wherein said bottom portion of the washout channel is connected to a bottom portion of the primary P-trap so as to create a path for forcibly removing the effluent liquid from the P-trap and reservoir.

11. The hybrid urinal of claim 10, wherein the water in the washout channel is at a pressure greater than a pressure of the effluent liquid.

12. The hybrid urinal of claim 8, wherein said reservoir and primary P-trap are formed as one single component.

13. The hybrid urinal of claim 1, wherein said collection unit includes a P-trap positioned at a bottom end thereof, said collection unit P-trap being configured to allow fluids to pass into the drain unit while preventing odors from escaping therefrom.

14. The hybrid urinal of claim 13, wherein said drain unit includes a reservoir for storing a portion of the effluent liquid and is configured to be connected to a building drain.

15. The hybrid urinal of claim 14, wherein said bottom portion of the washout channel is connected to a bottom portion of the reservoir so as to create a path for forcibly removing the effluent liquid from the reservoir.

16. The hybrid urinal of claim 15, wherein the water in the washout channel is at a pressure greater than a pressure of the effluent liquid.

17. The hybrid urinal of claim 1, wherein said collection unit and said drain unit are formed as one single component.

18. The hybrid urinal of claim 1, wherein said flush unit further includes a automatic flush valve configured to allow a user to control at least one of a water volume and a number of uses between each flush.

19. The hybrid urinal of claim 1, wherein said diverter unit is configured to provide water to the receptacle through the plurality of inlets.

* * * * *